United States Patent [19]

Wolters et al.

[11] Patent Number: 4,735,466

[45] Date of Patent: Apr. 5, 1988

[54] POP-UP KEYBOARD TRAY AND DESK PAD EASEL

[75] Inventors: Richard H. Wolters, Grand Rapids Township, Kent County; Arnold J. Hooton, Caledonia Township, Kent County, both of Mich.

[73] Assignee: Westinghouse Electric Corp., Pittsburgh, Pa.

[21] Appl. No.: 866,430

[22] Filed: May 23, 1986

[51] Int. Cl.[4] ..... A47B 81/00

[52] U.S. Cl. ..... 312/24; 312/30; 248/1 B

[58] Field of Search ..... 312/195, 23, 24, 25, 312/26, 22, 110, 331, 341 R, 27, 28, 29, 30; 248/1 A, 1 B, 1 C

[56] References Cited

U.S. PATENT DOCUMENTS

| | | | |
|---|---|---|---|
| Re. 28,835 | 6/1976 | Roberts et al. | 312/22 |
| 401,314 | 4/1889 | Travis | 312/26 |
| 722,000 | 3/1903 | Deimel | 312/25 |
| 3,794,401 | 2/1974 | Dean et al. | 312/333 |

*Primary Examiner*—Kenneth J. Dorner
*Assistant Examiner*—Gerald Anderson
*Attorney, Agent, or Firm*—B. R. Studebaker

[57] ABSTRACT

A concealed keyboard support tray in combination with a work surface wherein a desk pad on the work surface is movable from a position overlying the keyboard support tray to a position rearward of the keyboard support tray to form a work-supporting easel while the keyboard support tray pops up from beneath the work surface to work surface level to provide access to a keyboard situated on the keyboard tray.

11 Claims, 4 Drawing Sheets

POP-UP KEYBOARD TRAY AND DESK PAD EASEL

BACKGROUND OF THE INVENTION

This invention relates to computer work stations or desks and more particularly to a computer keyboard support which is conveniently stored within the work station work surface but is readily accessible for use at the work surface level.

There has been a tremendous influx of small business computers into the office of today. The appearance of a work station has greatly changed over the past few years with the typical office or work station desk work surface being continuously covered by computer peripherals including computer keyboards, visual display terminals, disc drives and printers. This, of course, is not critical with respect to a work station or desk at which the computer system is utilized for a substantial portion of the work day. However, computers are now being used by executives and managers on a casual but daily basis to quickly access important business information such as engineering data, marketing and sales information, production information as well as electronic mail. Although the keyboard storage and support system of this invention is particularly adapted for the executive's or manager's desk it can be equally useful in a computer work station at which the computer is used throughout most or all of the work day.

Many different approaches have been taken for supporting a computer keyboard while in use and some approaches have even considered storing the keyboard in an out-of-the-way place during non-use. For example, it is common practice to support a computer keyboard on a keyboard support which is attached to an arm mounted beneath the work surface permitting the keyboard support to be stored beneath the work surface when not in use and swung outwardly beyond the front edge of the desk for normal use. Some of these articulating type arms even include spring-urged lift mechanisms which will permit the keyboard support to be swung out from beneath the work surface and raised to work-surface levels. A similar device is illustrated in U.S. Pat. No. 4,546,708 for DESK TOP ORGANIZER although in that construction the articulating arm is attached to the top of the work surface. The problem with these units is that, in the use position, the keyboard extends beyond the front edge of the work surface. To utilize these keyboard trays the operator is forced to move away from the work surface by a distance of the keyboard in addition to proceeding through an elaborate set of motions to pull out and set the keyboard into a proper position for use. This consumes extra space and time which are both becoming more and more of a premium as time progresses. In addition, with the advent of the introduction of flat computer screens into the office, the articulating-type solutions force the operator away from the screens creating an excessive distance between the operator and the screen when the screen is located in the most convenient location which is at the opposite edge of the work surface.

Other solutions have been provided but each of these create the continuing appearance of a computer work station as opposed to a typical planar surfaced desk or work station. For example, design patent U.S. Pat. No. Des. 266,467 for COMBINED DESK AND AUXILIARY SHELF FOR A DATA TERMINAL discloses an open recess in the front portion of the desk for receiving and supporting a computer keyboard. U.S. Pat. No. 4,449,762 for COMPUTER DESK discloses a multi-level work surface wherein the various computer peripherals are supported at different levels on the work surface. U.S. Pat. No. 4,515,086 for ADJUSTABLE WORD PROCESSOR WORK STATION discloses a computer work station which includes a U-shaped cutout at the front edge of the work surface with the provision for an adjustable tiltable keyboard support platform to be mounted in the U-shaped opening at a level slightly below that of the work surface.

As will be apparent, none of the prior art solutions to the problem of keyboard support and accessibility provide a system wherein the keyboard or terminal can be completely hidden from view in its unused position and which is quickly accessible, in the proper location for use, through a simple mechanical movement of a cover or desk pad from a position overlying the keyboard to a position where that cover forms an easel.

SUMMARY OF THE INVENTION

The unique pop-up keyboard tray and desk pad easel of this invention provides for both a concealed storage location for a computer keyboard and quick access for use by providing in combination with a work surface having an aperture therethrough adjacent one edge thereof, a computer keyboard support tray mounted beneath the aperture for relative movement into and out of the aperture with closure means on the work surface overlying the aperture and covering the support tray when the closure means is in its closed position. The closure means is movable to an open position exposing the aperture and the keyboard tray and including means cooperating with the closure means and the keyboard tray to move the keyboard tray into the aperture when the closure means is moved from its closed position to an open position. The closure means is preferably a desk pad. The combination includes means cooperating with the closure means and the keyboard tray including a housing, track means within the housing for controlling the movement of the closure means between its closed and open position and spring means interconnecting the housing and the keyboard tray urging the keyboard tray into the aperture in the work surface. The spring means is preferably a leaf spring. The combination further includes stop means associated with the keyboard tray to limit the extent the keyboard tray can move into the aperture in response to the urging of the spring means.

More specifically, this invention involves a keyboard support tray, operable in combination with a work surface, which may be stored in a concealed condition when not in use and comprises in combination a work surface having an aperture therethrough adjacent the front edge thereof with a movable cover in the form of a desk pad overlying the aperture in the work surface in its closed position and movable to an open position uncovering the aperture. A housing underlies the aperture and is secured to the underside of the work surface. A keyboard support tray is hingedly mounted within the housing and spring means interconnects the housing and the keyboard support tray to normally urge the keyboard support tray out of the housing and into the aperture in the work surface. Flange members are secured to the underside of the cover adjacent each side edge thereof which flange members extend into the housing and have a pinion gear rotatably mounted thereto which coact with a gear runner secured within the housing at each side thereof to provide for a controlled, smooth non-racking movement of the cover from its closed to its open position, the cover forming an angle with the work surface in its open position to thereby provide an easel for supporting work papers thereon.

BRIEF DESCRIPTION OF THE DRAWINGS

Many of the attendant advantages of the present invention will become more readily apparent and better understood as the following detailed description is considered in connection with the accompanying drawings in which.

DESCRIPTION OF THE PREFERRED EMBODIMENT

Figure 1:
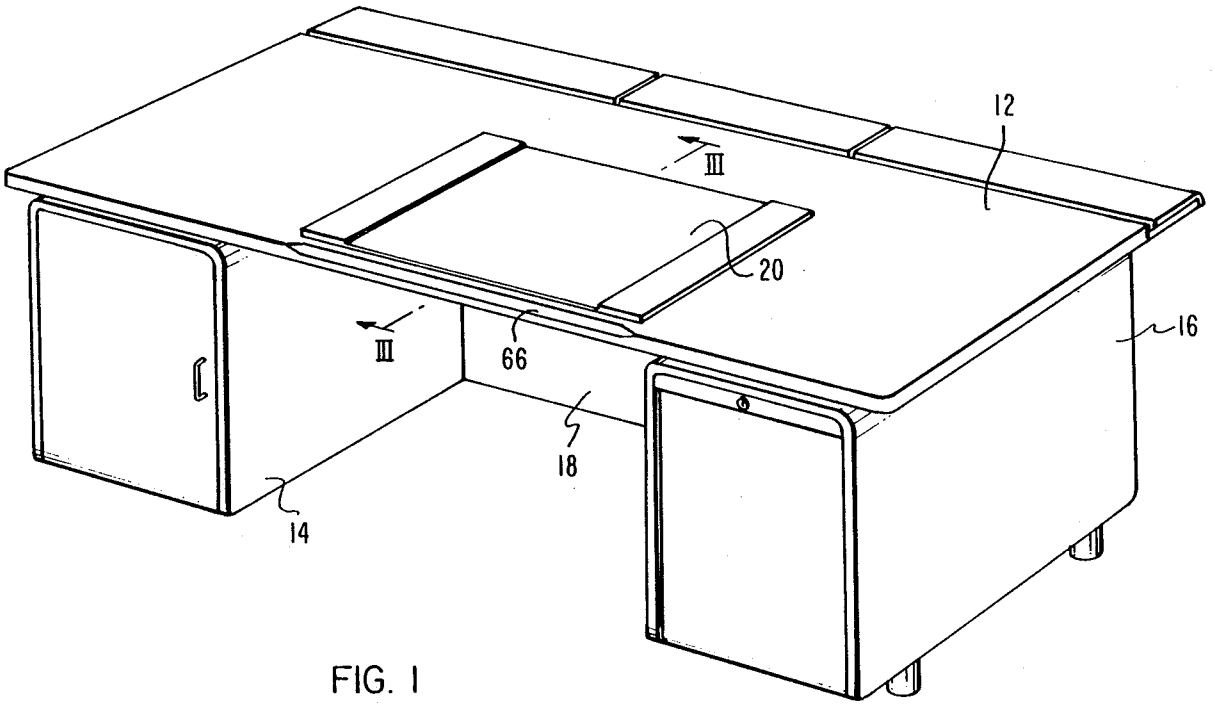
FIG. 1 is a perspective view of a desk including the keyboard support tray of this invention in its closed and covered mode.
Figure 2:
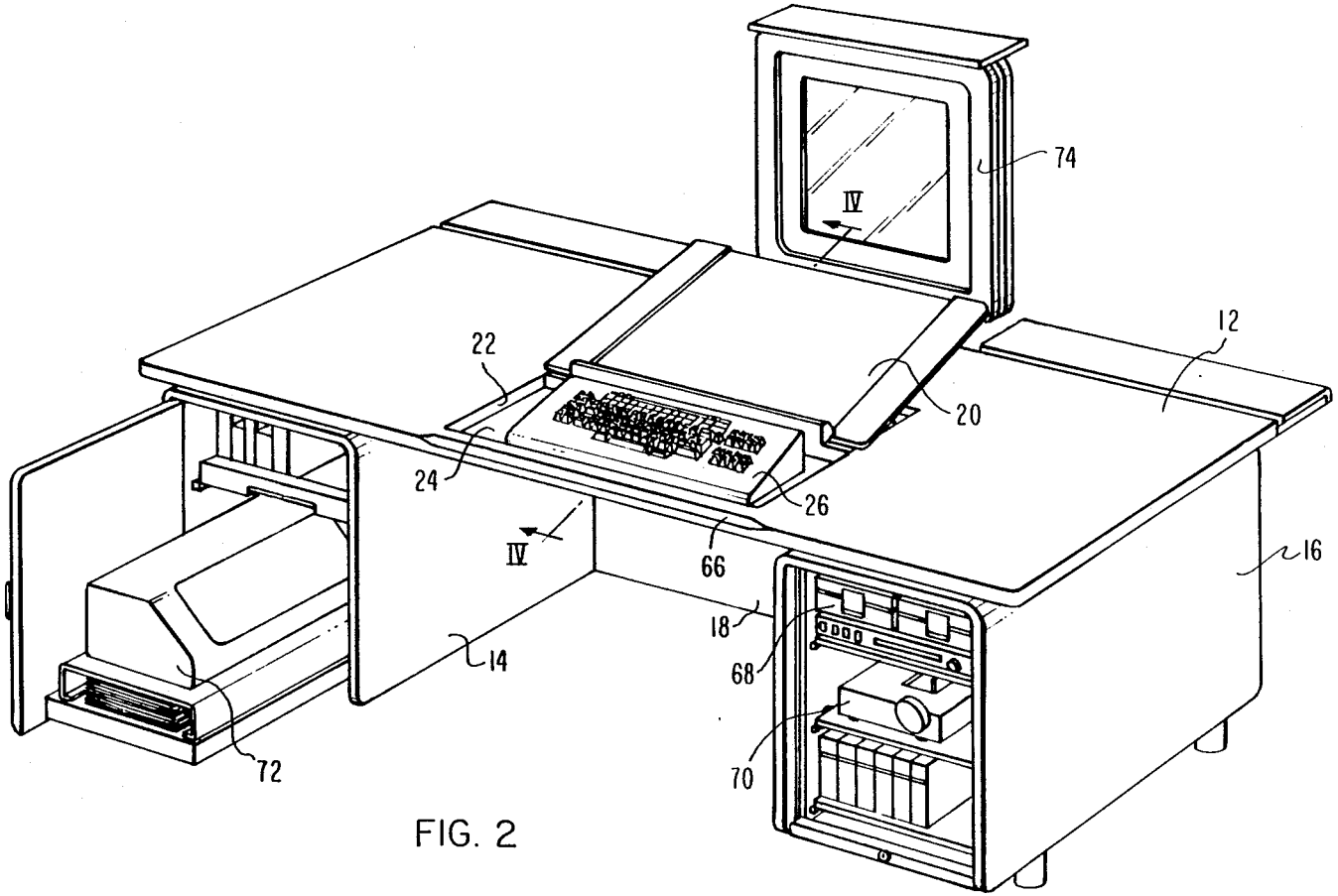
FIG. 2 is a perspective view similar to FIG. 1 with the Keyboard support tray and easel in their operational mode.

Referring now in detail to the drawings wherein like reference characters represent like parts throughout the several views there is illustrated in FIGS. 1 and 2 the computer integrated desk which is disclosed in detail in copending application Ser. No. 866,514 filed the same day as this application titled COMPUTER INTEGRATED DESK and owned by the present assignee. It should be understood that although the pop-up keyboard support and desk pad easel of this invention may be used in combination with the aforesaid computer integrated desk and is herein disclosed as a part of that combination, it is equally applicable for use in any computer work station application wherein a VDT screen, disk drive printer and like computer peripherals are located at all times on the work surface of the computer work station. As illustrated in FIG. 1, the conventional appearing desk includes a planar work surface 12, a pair of work surface supporting storage pedestals 14 and 16 and a modesty panel 18. Centrally over the knee space adjacent the front edge of the work surface 12 between the support pedestals 14 and 16 a desk pad 20 overlies and conceals an aperture 22 (FIG. 2) in the work surface 12. In accordance with the present invention when the desk pad 20 is merely pushed forwardly toward the rear of the desk a keyboard support tray 24 supporting a computer keyboard 26 pops up into the space vacated by the desk pad 20 while the desk pad 20 is supported at an angle with respect to the work surface to provide a sloped easel for supporting operator work papers when the computer key board is in use.

Figure 3:
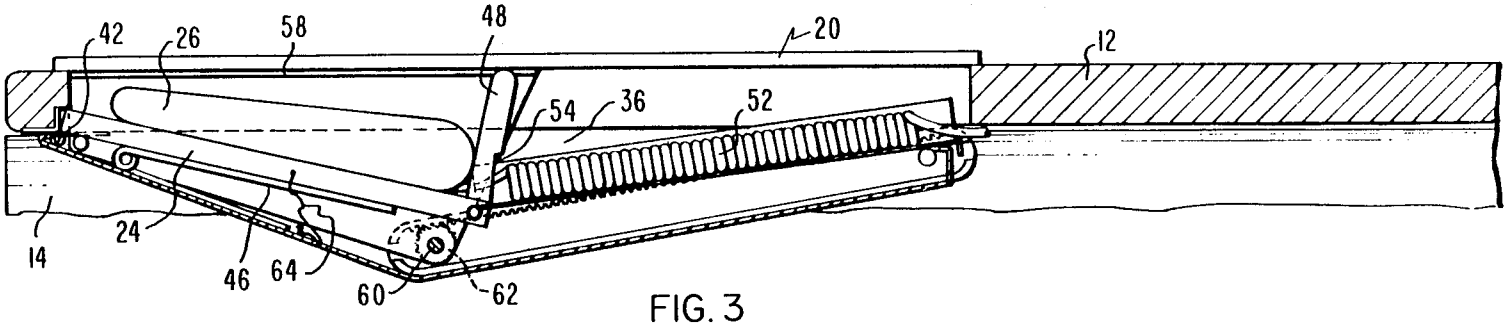
FIG. 3 is a sectional view taken along the line III—III of FIG. 1.
Figure 4:
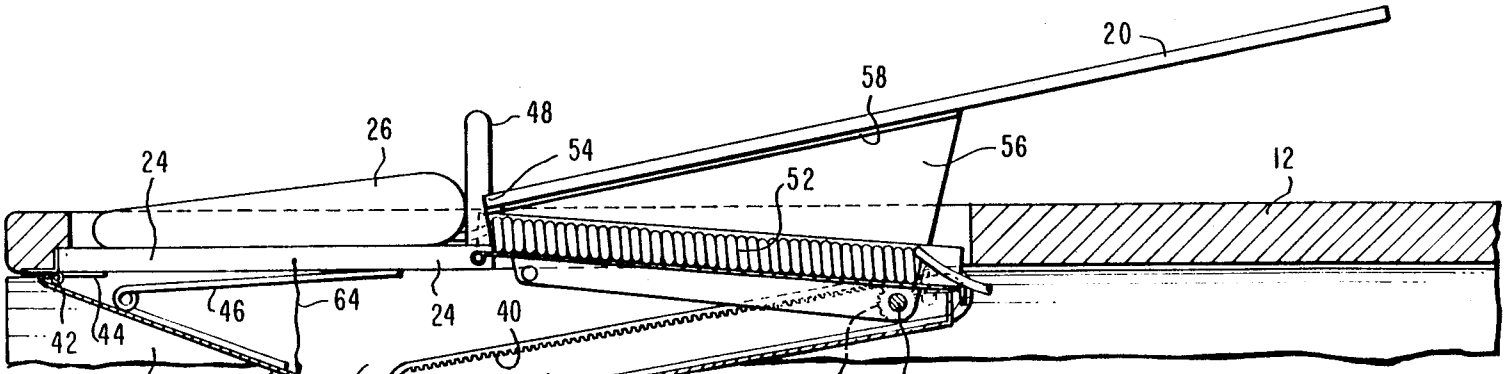
FIG. 4 is a sectional view taken along the line IV—IV of FIG. 2.
Figure 5:
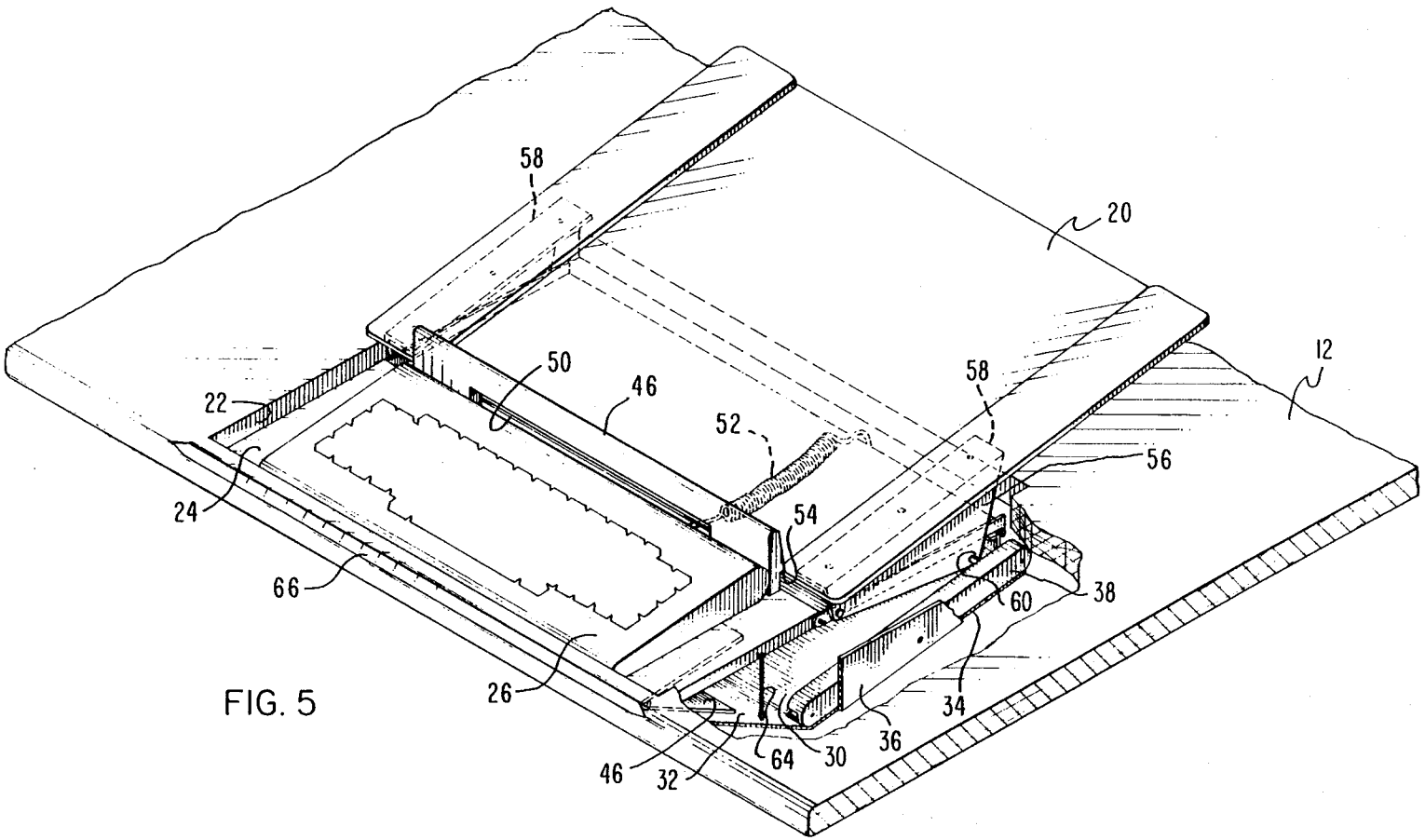
FIG. 5 is a partial perspective view similar to FIG. 2 with portions of the work surface broken away.

Referring now more specifically to FIGS. 3, 4 and 5, the pop-up keyboard and desk pad easel of this invention will be described in detail. A housing 30 is secured to the underside of the work surface 12 beneath the aperture 22. The housing 30 includes a downwardly and rearwardly sloping front bottom wall 32 and an upwardly and rearwardly sloping rear bottom wall 34 and a pair of side walls 36. Fixed to each side wall 36 and extending along the rear bottom wall 34 are gear runners 38 which include a gear rack 40 on the upper side thereof. Adjacent the intersection of the housing front bottom wall 32 and the work surface 12 there is hingedly mounted at 42 by a hinge 44 the keyboard support 24. Also mounted to the front bottom wall 32 is a leaf spring 46 which coaxes with the underside of the keyboard support 24 to urge the keyboard support into the aperture 22. At the opposite end from the hinge mounting 42 there is the keyboard support tray locking bar 48 which extends vertically at right angles from the keyboard support tray and includes a slot 50 therethrough to permit a power cable 52 to connect to the computer keyboard 26. The locking bar 48 also includes an undercut lip 54 which serves to lock the keyboard support tray 24 in a horizontal position when the keyboard is in its operational position.

The desk pad is interconnected to the housing 30 by means of a pair of flange members 56 each of which include a horizontal flange 58 secured to the lateral undersides of the desk pad 20. The flange members 56 include a large quadrilaterally shaped body portion extending downwardly from the flange 58 having pivotally mounted in the furtherest corner from the flange 58 an axle 60 which carries thereon a pinion gear 62. The pinion gear coaxes with the rack gear 40 to provide a smooth non-racking motion to the desk pad as it is moved to and from its closed and open positions.

In operation, when it is desired to use the computer keyboard 26 which is stored beneath the closure member or desk pad 20 as illustrated in FIGS. 1 and 3, the desk pad is merely pushed toward the rear of the desk with very little effort. As the desk pad moves smoothly rearwardly as controlled by the interaction of the pinion gears 62 and the gear racks 40. The slope of the gear runners 38 and the configuration of the flange 56 will cause the rearward edge of the desk pad to rise away from the top of the work surface 12. After the front edge of the desk pad 20 clears the top edge of the locking bar 48 the leaf spring 46 will cause the keyboard support to pop-up into the aperture 22 with the extent of pivotal movement of the keyboard support tray 24 under force from the leaf spring 46 being limited by a stop in the form of the cord 64. Once the keyboard tray has risen to its operable position the desk pad 20 is moved back toward the front of the desk until the front edge of the desk pad enters the undercut lip 54. This locking mechanism prevents the keyboard support from moving downwardly in response to pressure on the keyboard keys. As will be seen the desk pad is now positioned at an angle with respect to the work surface and provides an easel for supporting the computer operator's work papers.

To store the keyboard when not in use, the desk pad is merely moved rearwardly slightly to disengage the front edge of the desk pad from the undercut lip 54 and the keyboard support tray depressed by hand against the action of the leaf spring 46 until the top edge of the locking bar 46 moves beneath the front edge of the desk pad and the desk pad 20 is then simply moved to its normal position and the camming action of the pinion gear moving in the gear runner 38 toward the front of the desk will move the desk pad to its normal position overlying the keyboard and the aperture 20. A beveled edge 66 can be provided in the front edge of the desk adjacent the aperture 20 to provide a comfortable hand rest for the keyboard operator.

The pop-up keyboard and desk pad easel of this invention can be used in combination with the computer integrated desk disclosed in the aforementioned copending application Ser. No. 866,514, filed the same day as this application, which also includes storage within the pedestals 14 and 16 for computer peripherals such as disk drives 68, a small printer 70 or a large printer 72. Additionally, the keyboard support of this invention can also be utilized in conjunction with the stow-away flat screen mechanism disclosed in copending application Ser. No. 866,513 for STOW-AWAY FLAT SCREEN MECHANISM, filed the same day as this application and owned by the present assignee, which discloses a mechanism for raising and lowering a flat screen VDT of the type illustrated at 74 in FIG. 2.

As will be seen from the foregoing, the pop-up keyboard support and desk pad easel of this invention provides for the storage of a computer keyboard in a position completely hidden from view when not in use and further makes that keyboard readily accessible through a simple movement of the desk pad cover. As an additional feature, the cover or desk pad serves as a dust cover for the computer keyboard when the keyboard is in its stored position. Although the pop-up keyboard support and desk pad easel of this invention has been disclosed in conjunction with a total computer integrated desk it should be understood that it may be used in conjunction with any work surface whether the remaining computer peripherals are integrated into the desk or not.

We claim:

1. A computer keyboard support tray operable in combination with a work surface to be stored in a concealed condition when not in use, said combination comprising;

a work surface having an aperture therethrough adjacent one edge thereof, a movable cover overlying said aperture in said work surface in a closed position and movable to an open position uncovering said aperture, a housing underlying said aperture and secured to the underside of said work surface, a keyboard support tray hingedly mounted within said housing, spring means interconnecting said housing and said keyboard support tray normally urging said keyboard support tray out of said housing and into said aperture, and means interconnecting said cover and said housing whereby movement of said cover from a closed position to an open position permits said spring means to move said keyboard support tray to a usable position when said cover is in the open position.

2. The combination according to claim 1 wherein means interconnecting said cover to said housing includes a flange member secured to the underside of said cover adjacent each side edge thereof, said flange members extending into said housing and having a pinion gear rotatably mounted thereto, and a gear runner secured to said housing at each side thereof having a gear rack therein interacting with said pinion gears on said flange member for controlling the smooth, non-racking movement of said cover from its closed to its open position.

3. The combination according to claim 1 wherein said cover is a desk pad.

4. The combination according to claim 1 wherein said spring means is a leaf spring and stop means interconnecting said keyboard support tray and said housing controls the distance said leaf spring urges said keyboard support tray into said aperture.

5. The combination according to claim 4 wherein said stop means is a cord.

6. The combination according to claim 1 wherein said cover, when moved from its closed position to its open position, forms an angle with said work surface to thereby provide an easel for supporting work papers thereon.

7. In combination with a work surface, a concealed computer keyboard support tray comprising in combination;

a work surface having an aperture therethrough adjacent one edge thereof, a computer keyboard support tray mounted beneath said aperture for relative movement into and out of said aperture, closure means on said work surface overlying said aperture and covering said support tray when said closure means is in a closed position, said closure means movable to an open position exposing said aperture and said keyboard tray, and means cooperating with said closure means and said keyboard tray including a housing secured to said work surface beneath said aperture, track means within said housing for controlling the movement of said closure means between a closed position and an open position, and spring means interconnecting said housing and said keyboard tray operable to move said keyboard tray into said aperture when said closure means is in an open position.

8. The combination according to claim 7 wherein said closure means is a desk pad.

9. The combination according to claim 7 wherein said spring means is a leaf spring.

10. The combination according to claim 7 wherein stop means is associated with said keyboard tray to limit the extent said keyboard tray can move into said aperture in response to the urging of said spring means.

11. The combination according to claim 10 wherein said stop means is a cord connected at one end to said keyboard tray and at the other end to said housing.

* * * * *